United States Patent [19]

Harris

[11] 4,435,239

[45] Mar. 6, 1984

[54] PNEUMATIC TOW BLOOMING PROCESS

[75] Inventor: James E. Harris, Bristol, Tenn.

[73] Assignee: Eastman Kodak Company, Rochester, N.Y.

[21] Appl. No.: 359,968

[22] Filed: Mar. 19, 1982

[51] Int. Cl.[3] ..... D01D 11/02

[52] U.S. Cl. ..... 156/180; 28/283; 156/441

[58] Field of Search ..... 156/180, 441, 436, 166; 28/282, 283; 19/657, 665; 239/597, 598, DIG. 7; 226/7, 97; 493/44, 42, 49, 48

[56] References Cited

U.S. PATENT DOCUMENTS

| | | | |
|---|---|---|---|
| 2,908,045 | 10/1959 | Stevens | 19/665 |
| 3,017,309 | 1/1962 | Crawford et al. | 28/283 |
| 3,050,430 | 8/1962 | Gallagher | 156/166 |
| 3,079,663 | 3/1963 | Dyer et al. | 28/283 |
| 3,258,823 | 7/1966 | Stevens et al. | 28/283 |
| 3,262,178 | 7/1966 | Aspy, Jr. et al. | 28/283 |
| 3,262,181 | 7/1966 | Hawkins et al. | 28/283 |
| 3,413,698 | 12/1968 | Fritz et al. | 28/283 |
| 3,960,645 | 6/1976 | Brackmann et al. | 28/283 |

*Primary Examiner*—Michael W. Ball

*Attorney, Agent, or Firm*—Malcolm G. Dunn; Daniel B. Reece, III

[57] ABSTRACT

Process for treatment of crimped filter tow in preparation for forming tobacco smoke filter rods and including steps of separating and blooming the crimped filter tow into a wide, flat, well-opened low density tow, uniformly applying plasticizer to both sides of and through the tow across the width thereof, and then squeezing the tow and spreading the plasticizer more uniformly on the filaments of the tow; and a jet and improved bustle tow blooming apparatus, the jet and bustle apparatus both being rectangular-shaped and the bustle apparatus having vented outlets through which the gases confined with the tow escape causing separation and blooming of the tow prior to its exit from the bustle apparatus.

5 Claims, 6 Drawing Figures

PNEUMATIC TOW BLOOMING PROCESS

TECHNICAL FIELD

My invention relates to an improved process for "blooming" or "opening" crimped multifilament tow bands, such as for use in blooming crimped filter tows prior to conversion into tobacco smoke filter rods or the like.

BACKGROUND ART

In prior art blooming processes, such as in filter tow processes preparatory to manufacturing tobacco smoke filter rods, the two is removed from a bale and is spread by means of a pneumatic banding jet, then bloomed through use of semi-tension techniques in which alternate sections of the tow band are tensioned and relaxed with grooved metal rolls in order to deregister the fiber crimp and separate the filaments. Although relatively effective, a disadvantage of this method is that the tow must actually be stretched and tensioned to separate the filaments. This is detrimental because stretching and tensioning the fiber by use solely of the aforementioned semi-tension techniques, which usually also include the use of pretension rolls, can remove a portion of the crimp and diminish the usefulness of the tow for making filter rods having a range of pressure drop and removal characteristics, i.e. the "capability range" of the tow is diminished. This effect occurs with all semi-tension processes and becomes more severe as the process speed is increased. Semi-tension processes also do not generally separate the filaments in the tow band to an optimum degree. Consequently "tow yield", which is related to the pressure drop per unit weight that can be obtained from the fiber, is lost with a resultant increase in final filter cost.

"Capability range" is defined as the range of pressure drop and weight characteristics which can be obtained from a given tow item, when it is manufactured into a tobacco smoke filter of fixed length and diameter. Additional capability range such as can be obtained with the process disclosed herein is particularly important for high-speed processing of filter tow since capability range for a given tow item generally decreases as processing speed is increased. Loss in capability range can make it difficult if not impossible to obtain desired rod weight and pressure drop characteristics.

After the two is bloomed on semi-tension processes, it is generally sprayed with plasticizer for the purpose of ultimately bonding the filaments to one another to produce a firm rigid structure that will not soften or collapse during smoking. The plasticizer spray is generally applied to only one side of the bloomed tow band and, if examined carefully, is found to deposit primarily on the surface of the tow band. Failure of the plasticizer particles to penetrate the band occurs primarily as the result of inadequate separation of the filaments at the point of plasticizer application by these processes. Application of plasticizer from only one side, of course, compounds the problems. The end result is loss of rod firmness and less-than-optimum collapse characteristics.

This type of process can also suffer from band width variation through the plasticizer application, which generally causes plasticizer application level to vary.

Another process known as the Eastman E-60 process (Eastman Kodak Company), as discloed, for instance, in U.S. Pat. No. 3,258,823, utilizes air rather than tension to bloom or separate the filaments in the tow band.

Because the tow band experiences less tension with this type of process, less crimp is removed from the fiber and longer "effective" capability ranges can be obtained. One major disadvantage of this process is that the tow emerging from the jet after blooming has a cylindrical rope-like form that is unsuitable for the application of plasticizer. Plasticizer is therefore applied prior to the jet with a double-sided contacting "wick type" applicator which applies plasticizer to both sides of the unbloomed tow band. Penetration of the band is poor but double-sided application partially offsets this problem. One problem that arises with this process is that the plasticizer apparently interferes with the pneumatic blooming or separation of the filaments. As a result yield is lost, especially when low denier per filament, high total denier tow items are processed.

Other disadvantages arise from the small cylindrical entrance to the jet used for the Eastman E-60 process which can cause the machine to break down if filter tow with defects such as splices, end couplings or cut edges is processed.

Other disadvantages arise from the contact-type wick application which can cause filament breakage in the tow band. Band width fluctuation over the application wicks can also cause plasticizer level variation.

DISCLOSURE OF INVENTION

In accordance with the present invention, I provide a process for treatment of tow in preparation for forming tobacco smoke cigarette filter rods. The process involves the steps of (1) withdrawing a continuous multifilament crimped tow from a supply source; (2) banding the crimped tow to a predetermined width wider than the tow at the supply source by removing false twist from the tow, spreading the tow and partially breaking up bundles of crimped filaments; (3) feeding the banded tow to a first zone and applying tension axially to the filaments across the width of the banded crimped tow to extend the crimp in and to partially deregister the crimped filaments within the tow and to partially bloom the tow; (4) feeding the partially bloomed banded crimped tow to an enclosed second zone and further spreading the width of the tow within the second zone into a wide flat bundle of filaments by impelling a flat gaseous compressed stream in impingement against opposite sides of and across the width of the bundle of filaments at an angle less than 90° to the longitudinal axis of the bundle sufficient to penetrate the bundle to encompass the filaments with the gaseous compressed stream and to propel the bundle toward and through a tapering exit of the second zone; (5) feeding the bundle of filaments into a partially enclosed, wide rectangular third zone and therein momentarily confining and rapidly decelerating the linear speed of the bundle, applying compression against the mass of the bundle and allowing the bundle to be momentarily stored under conditions of low longitudinal tension, simultaneously allowing the flat gaseous compressed stream to expand and escape from the third zone at a location prior to the exit for the bundle from the wide rectangular third zone and thereby expand and bloom the filaments and cause the filaments to fill the wide rectangular third zone and to relax and recover a portion of their crimp, thereby forming a flat wide low density bloomed tow; (6) feeding the bloomed filaments of the wide flat low density tow to a fourth zone and uniformly applying plasticizer at a consistent rate to both sides of and through the tow across the width thereof; (7) feeding the tow to a fifth zone through and between two rolls to squeeze and to spread the plasticizer more uniformly on the filaments; and then (8) feeding the tow onward for subsequent processing into filter rods.

The process may also involve feeding the bloomed filaments of the wide flat low density tow to a sixth zone and therein apply tension to the tow sufficient to remove the tow from the rolls in the fifth zone and to extend the crimp in the filaments in a nonpermanent manner; and to impel the tow from the sixth zone into a relatively quiescent area at a velocity sufficient to cause retarding of such velocity upon hitting such area to thereby enable recovery of the crimp in the filaments.

The process may still also involve feeding the banded tow to the aforementioned first zone and then applying differential tension axially to alternating segments of the two across the width of the banded crimped tow.

The process may further involve feeding the banded tow to the aforementioned fifth zone through and between two rubber rolls.

The process involves applying plasticizer in the form of an aerosol to the banded tow.

Also in accordance with the present invention, I provide a jet for treating filter tow and bustle blooming apparatus or assembly. The jet is of the type that has a rectangular-shaped nozzle assembly through which tow enters into the jet in banded form, and a rectangular-shaped throat assembly that is connected to the nozzle assembly and that defines a venturi-shaped passage having a width greater than the banded tow. The banded form of tow in the venturi-shaped passage is caused to spread to a greater width upon being contacted by gases entering into the venturi-shaped passage and becoming confined in compressed form around the tow. The improvement comprises a rectangular-shaped bustle tow blooming chamber connected to the outlet of the venturi-shaped passage of the jet, the bustle chamber having inlet and outlet ends through which tow moves into and out of the bustle chamber from the venturi-shaped passage. The rectangular shaped bustle chamber has therewithin an adjustable tension arrangement for engagement against the tow to rapidly decelerate and retard its movement through the bustle chamber. The bustle chamber also defines along its length an outlet arrangement that extends through and across the width of the bustle chamber at a location between the inlet and outlet ends and before the adjustable tension arrangement for enabling substantially most of the compressed gas surrounding and accompanying the tow as it moves into the bustle chamber to expand and escape from the bustle chamber. The bustle chamber outlet arrangement also includes an arrangement for restraining the tow from also escaping therethrough.

The adjustable tension arrangement comprises a flexible plate extending in one direction across the width of the bustle chamber and in another direction along a portion of the length of the bustle chamber, and includes an adjustment arrangement for adjusting the flexible plate toward and away from the tow in the bustle chamber.

The adjustable arrangement for the flexible plate may be connected at one end of the flexible plate.

The outlet arrangement within the bustle chamber may define at least one rectangular slot that extends across the width of the bustle chamber.

BRIEF DESCRIPTION OF DRAWINGS

The details of my invention will be described in connection with the accompanying drawings, in which.

BEST MODE FOR CARRYING OUT THE INVENTION

Figure 1:
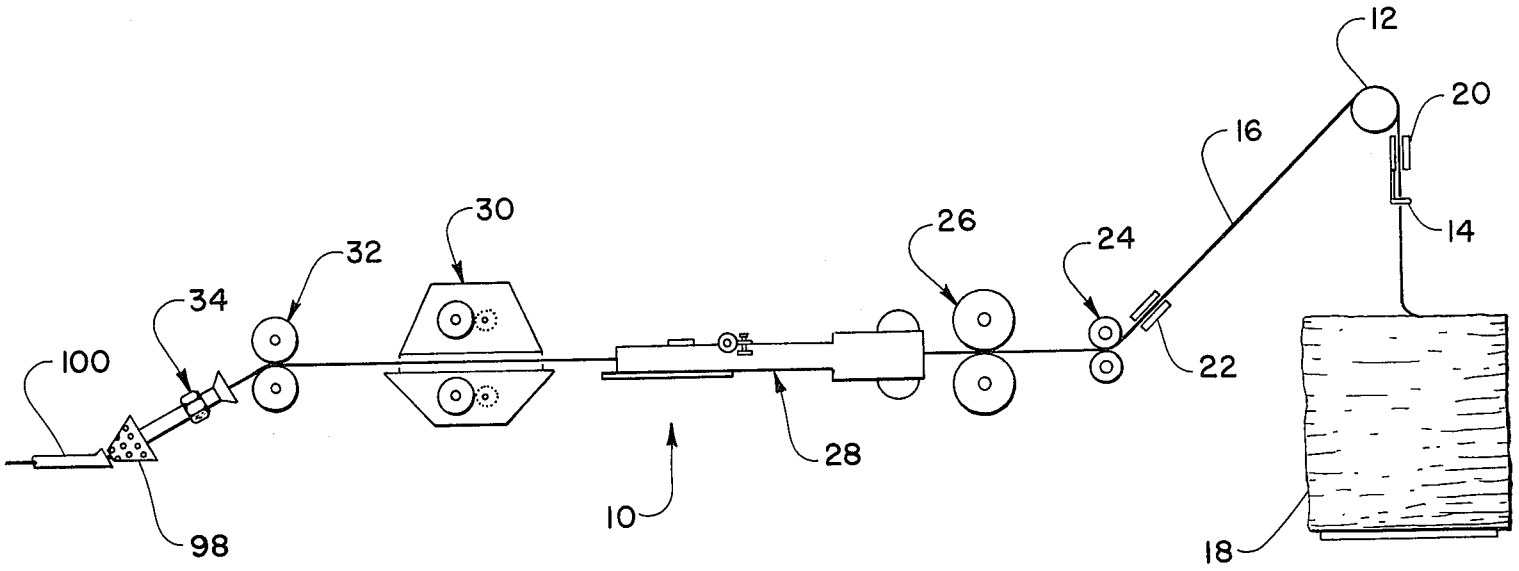
FIG. 1 is a diagrammatic elevational view of an apparatus that may be used for treating a multifilament tow.

In reference to FIG. 1 of the drawings, the apparatus shown at 10 for practice of the process comprises a tow withdrawal boom 12 and boom ring guide 14, through and over which tow 16 is withdrawn from a source of supply, such as bale 18; and a boom banding jet 20, which is interposed between the boom guide and the tow withdrawal boom.

The apparatus further comprises a pretension banding jet 22, constant tension pretension rolls 24, and driven feed rolls 26; a flat low pressure pneumatic jet and bustle tow blooming assembly 28, a double-sided constant rate plasticizer applicator 30, a pair of straight-through rubber or rubber-coated delivery rolls 32, and a transport jet 34 for subsequent feed of the tow to other processing apparatus such as the garniture (not shown) of a filter rod-making apparatus.

The tow withdrawal boom 12, boom ring guide 14 and boom banding jet 20 are conventionally known, such as shown in U.S. Pat. No. 2,908,045 (1959), for example, with the boom serving as an elevated guide which allows the tow to be lifted vertically from the bale surface and fed to the blooming section of the process.

Figure 2:
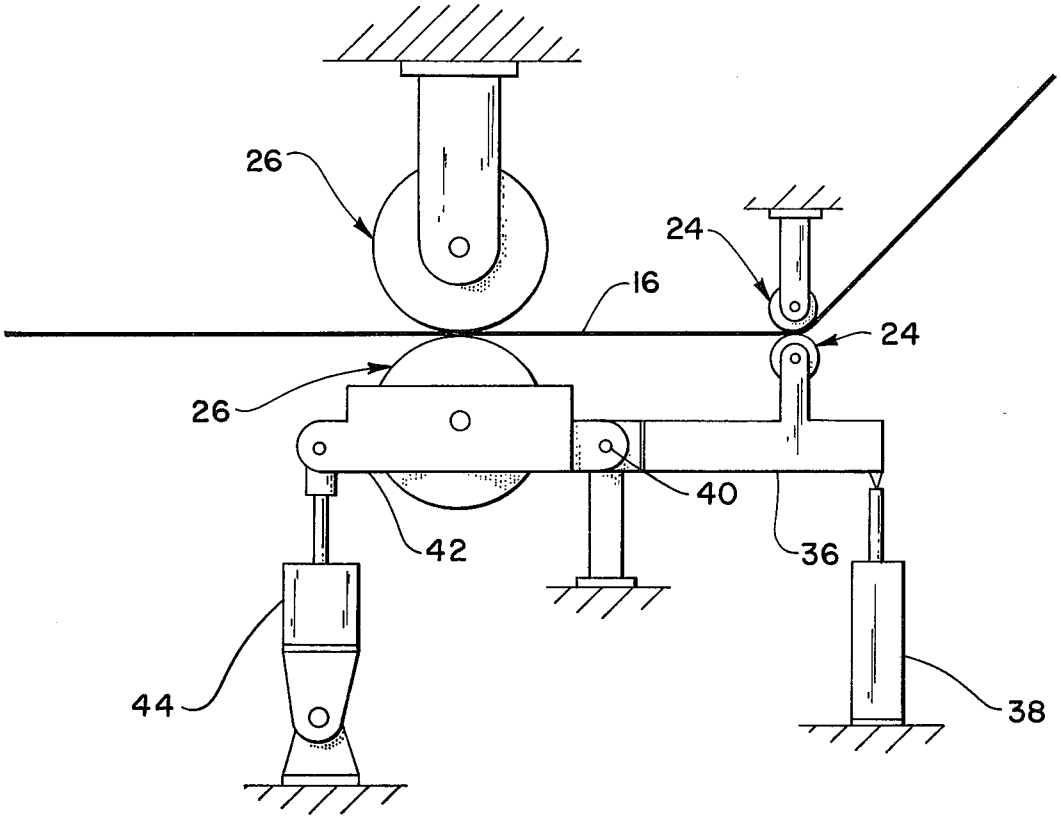
FIG. 2 is an elevational view broken away from the overall apparatus, showing the roll pressure adjustment arrangement for the pretension and feed rolls of the apparatus of FIG. 1.
Figure 4:
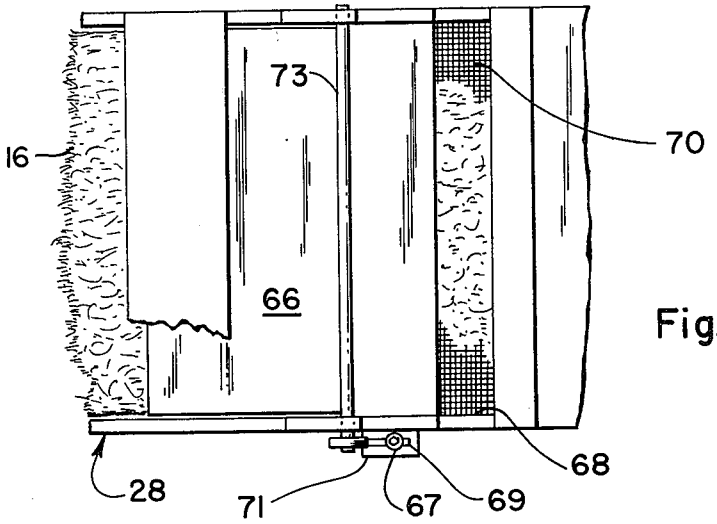
FIG. 4 is a partial plan view of the rectangular-shaped bustle tow blooming assembly shown in FIG. 3 and partly broken away.

The pretension banding jet 22, constant tension pretension rolls 24 and driven feed rolls 26 form a constant tension tow feeding and preblooming assembly which is also well known in the art. The pretension rolls 24 may be pneumatically loaded, as shown in FIG. 2 by the pivotal frame 36 and pneumatic cylinder 38. The frame 36 may be mounted to pivot 40. One of the pretension rolls may be rubber-coated and the other may be made entirely of metal, or both may be rubber-coated. The feed rolls 26 may also be pneumatically loaded, as also shown in FIG. 2 by the pivotal frame 42 and pneumatic cylinder 44. The pivotal frame 42 may also be mounted to pivot at 40. One of the feed rolls may have a grooved metal surface (not shown) and the other may have a smooth rubber surface. As the banded tow passes through the pretension rolls, tension may be applied as a result of a squeezing force which is applied to the rolls pneumatically. "Pretensioning" is described, for instance, in U.S. Pat. No. 3,258,823 (1966).

Since the tow 16 is pulled through the pretension rolls by the feed rolls, and since one of the feed rolls may have a grooved metal surface (not shown), the tow will experience differential tension in alternating segments across its width. This differential tension tends to deregister the crimped filaments and partially bloom the tow. In addition, this unit also serves the purpose of controlling the feed rate of the tow to the process which ultimately affects end product uniformity. The process, however, may also be operated with a smooth metal feed roll. Although less preblooming will occur with this latter metal feed roll, there is no apparent loss in overall performance of this total process.

In order to control feed rate and minimize the chance of process breakdown, it is important that the tension supplied by the pretension rolls be held as constant as possible with time. Since rotational speed of the rolls fluctuates with crimp level variation in the tow, it is important that the rotational inertia in the pretension rolls be kept to a minimum. The rubber-covered and metal rolls of this process, therefore, may be designed to have lower rotational mass and lower moment of inertia than some of the known previously-designed pretension rolls of the prior art.

Since the tension supplied by the rolls when operating at a constant rotational speed is primarily dependent upon the pneumatically applied squeezing force exerted by the rolls, it is important that this squeezing force be held constant. In commercial pretension units presently in use by the industry, the pneumatic loading force can vary as the result of frictional losses in either sliding bearing blocks or frictional losses associated with pneumatic loading cylinders.

Figure 3:
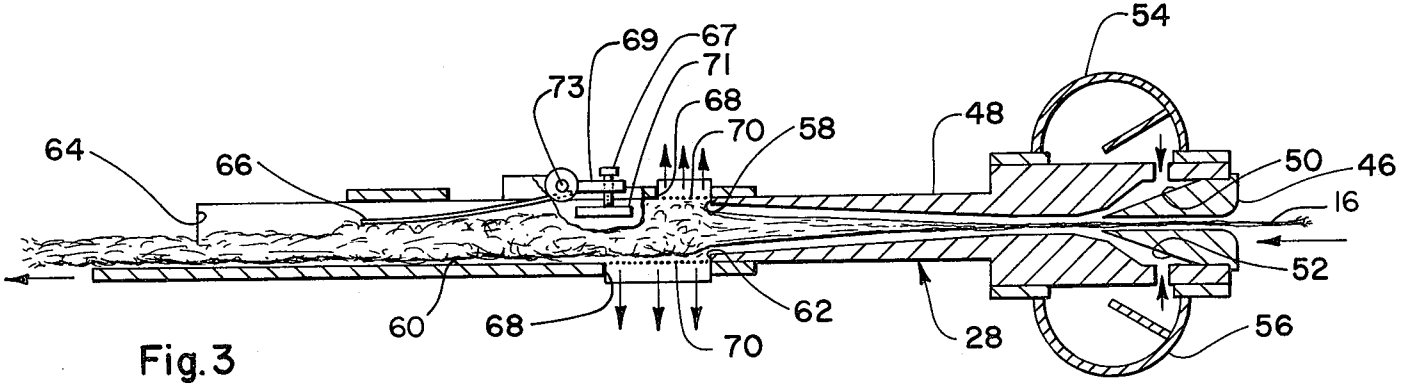
FIG. 3 is an elevational view in cross-section of the rectangular-shaped jet and rectangular-shaped bustle tow blooming assembly.

The pretension unit of this invention may eliminate the use of sliding bearing blocks (an example of sliding bearing blocks for rolls in general is shown in FIG. 3 of U.S. Pat. No. 3,413,698) and frictional losses in the pneumatic loading cylinder such as through use of an ultra low frictional "Air Pot" pneumatic loading cylinder, as shown at 38.

The most significant improvement to the ultimately-formed filter rod is due largely in part to the combination of the flat pneumatic jet and bustle tow blooming assembly 28, which converts the banded ribbon-like tow 16 into a wide, flat, low density bundle of fiber. Rectangular-shaped jets are known, as disclosed in U.S. Pat. No. 3,079,663, but the combination of jet and bustle tow blooming assembly and what is accomplished therein is believed to be unknown. This jet uses a rectangular-shaped nozzle assembly 46 and a rectangular-shaped throat assembly 48 which is connected to the nozzle assembly and defines a venturi-shaped passage having a width greater than the entering banded tow. The banded tow, which for example may have a width of about 16.51 centimeters (6.5 inches), passes through the rectangular-shaped nozzle assembly 46 and into the rectangular-shaped throat assembly 48. The jet operates by directing or impelling two flat streams of pressurized air or gas against the tow band from passages 50,52 connected, respectively, to upper air or gas chamber 54 and lower air or gas chamber 56. This causes the tow band to be spread to a greater width or to a width equal to the interior width of the rectangular-shaped throat assembly, which for example may be about 25.4 centimeters (10 inches). The two streams of air or gas impinge on the tow band from opposite sides at an angle of less than 90°, preferably about 30°, to the longitudinal axis of the tow band.

The pressurized gases penetrate the tow band, encompass the filaments of the tow band with the gaseous streams in compresse form and propel the tow band through the jet and bustle tow blooming assembly.

The bustle tow blooming assembly is connected to the outlet 58 of the venturi-shaped passage and defines a rectangular-shaped bustle chamber 60 having an inlet end 62 and an outlet end 64. As the tow band passes from he outlet 58 of the venturi-shaped passage into the inlet end 62 of the bustle chamber, the tow band becomes confined by a tension plate 66 and is thereby forced to rapidly decelerate, its movement through the bustle chamber being retarded. The tension plate may be adjusted against or away from the tow by the adjustment screw 67, which threadingly extends through lever 69 and abuts against abutment 71. The lever is connected to pivotal rod 73, which is connected to one end of the tension plate. Simultaneously the compressed gases surrounding the filaments of the tow band are allowed to expand and escape from the bustle chamber, causing the individual filaments in the band to be pulled apart and become separated or "bloomed". The compressed gases for the most part escape from the bustle chamber through vented outlets 68, which extend through and across the width of the bustle chamber at a location between the inlet end 62 and the outlet end 64 and before the tension plate 66. The vented outlets are preferably rectangular in configuration and are provided with screens 70 to prevent the filaments of the tow band from escaping therethrough along with the gases.

The bustle assembly is very significant to the tow blooming process. Without the bustle assembly the tow can be aspirated and spread, but will not be bloomed. It also provides a location where the bloomed tow can be temporarily stored under conditions of low tension. Under the latter conditions, the fiber is free to "relax" and recover a portion of the crimp that has been extended during earlier processing steps where tension was involved. The crimp recovery in turn provides added "capability range" (as heretofore defined) to the tow.

The flat jet is designed to operate with low pressure 21 kilopascals (less than 3 psi) blower-produced air instead of the high pressure 55 kilopascals (greater than 8 psi) air which is normally required for conventional pneumatic blooming jets such as used on the Eastman E-60 process (Eastman Kodak Company). Use of low pressure air is possible because of the large air-to-fiber interface area provided by the flat jet. The capability of using low pressure air allows the entire process to be self-contained with regard to air supply requirements because the air may be supplied by an internal blower. This eliminates the need for the large capital investment in expensive air compressing and piping facilities such as is normally required with the aforementioned E-60 type pneumatic blooming equipment.

Figure 5:
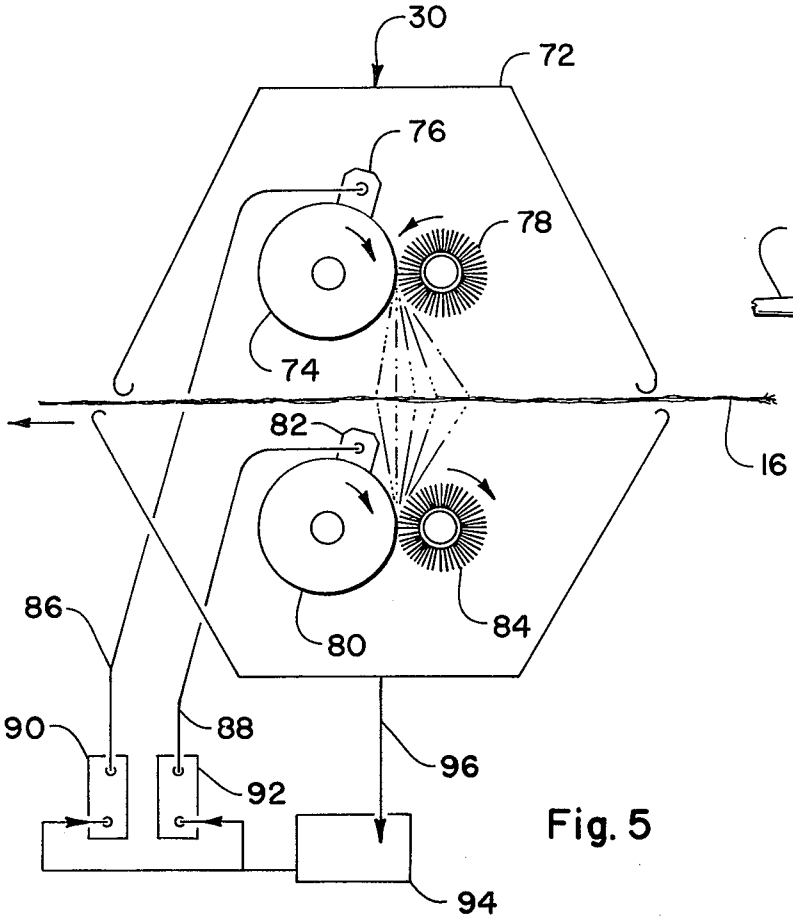
FIG. 5 is a diagrammatic elevational view of a plasticizer applicator for applying plasticizer to both sides of the multifilament tow.

The tow band, as it has been further spread wider in the jet and bustle assembly next passes into the double-sided plasticizer applicator 30, as shown in more detail in FIG. 5. This applicator is designed to apply plasticizer to both sides of the tow band, resulting in improved penetration of the tow band and thus providing uniform application along and across the tow band and also providing consistent plasticizer application regardless of process speed or process temperature. Thus after the tow has been spread wider and bloomed in the jet and bustle assembly, it is now presented to the plasticizer applicator in a very open form with a well-controlled band width. The opened or separated filaments allow plasticizer particles to readily penetrate the tow band. The controlled band width minimizes band width-induced plasticizer level variation. Penetration of the tow band and width-induced plasticizer level variations are both significant problems with conventional pneumatic and semi-tension tow blooming processes.

The plasticizer applicator includes a booth or an enclosure 72; a driven upper transfer roll 74 to the surface of which plasticizer is applied from the upper manifold 76 across the length of the roll 74; and a driven upper brush 78, which has short bristles and picks up plasticizer from the surface of he upper transfer roll 74 and flicks it in aerosol form toward the upper surface of the tow band passing therethrough. Concurrently there is also a driven lower transfer roll 80, a lower manifold 82, and a driven lower brush 84, which cooperate to apply plasticizer to the lower surface of the tow band in similar manner. Each manifold, for example, may comprise a block, such as may be made from plastic, having a slot therein filled with felt or wicking material. Plasticizer is supplied to each manifold through conduits 86,88, respectively, from positive displacement pumps 90,92, respectively, for the upper and lower manifolds, respectively. Plasticizer may be supplied from reservoir 94 to pumps 90,92. Excess plasticizer may be returned from applicator 30 through conduit 96 to the reservoir 94. The rotations of the two transfer rolls and two brushes are shown by the arrows.

To illustrate, for example, the degree of filament separation at the time of plasticizer application that is possible with the process of the present invention, an average center-to-center distance between filaments on a plane perpendicular to the longitudinal axis of the tow band can be determined. When processing a 3.4 D/F 45,000 total denier Y cross-section tow on this process, this distance was found to be 0.58 mm. The average distance between filaments of the same tow item as it passed through the plasticizer applicator of a conventional semi-tension process was found to be only about 0.20 mm.

The positive displacement pumps are directly linked to the blooming process drive. As the process speed is varied, pump speed is also varied, hereby insuring that plasticizer supply rate to the booth 72 is proportional to blooming process speed and resultant fiber through-put. The aforementioned porous fiber wicks (not shown) contained within the upper and lower manifolds are used to transfer the plasticizer to upper and lower transfer rolls 74,80. The transfer rolls in turn rotate during the application process and carry the plasticizer as a thin film to the nip between the transfer rolls and two cylindrical upper and lower brushes 78,84 respectively. The brushes, which rotate at high speed relative to the speed of the transfer rolls and are in intimate contact with the transfer rolls, pick up the plasticizer from the transfer rolls. Because of the high rotational speed of the brushes and resultant high centrifugal forces that are developed, plasticizer which has been picked up by individual brush bristles is expelled from the brush as an aerosol which is directed against each side of the tow band as it passes through the booth. The small plasticizer droplet size provided by this system in combination with well-opened tow band provided by the flat blooming jet incurs good penetration of the tow band.

Application systems used previously to apply plasticizer to fibrous tows include pump-fed air atomizing spray nozzles, electrostatic spray systems, high speed rotating wick-fed contact rolls, double-side wick applicator systems, dip roll brush application systems and pump-fed manifold brush application systems. A number of these are currently in use by various cigarette and filter manufacturing companies. Each system, however, has significant shortcomings such as single-sided application of plasticizer, excessive drag on the tow band, excessive overspray, nonuniform particle size, variable application rate across the tow band, poor penetration of the tow band, variable application rate with machine speed changes and variable application rate with machine warmups.

With most conventional tow blooming processes, after the filter tow has been withdrawn from the bale, metered to the process, bloomed and plasticized, it is generally fed to a driven set of vertically stacked metal rolls which deliver the tow to the garniture of a filter rod plugmaking machine. The plugmaker condenses the tow into a cylindrical rod, covers it with a paper overwrap and cuts it into appropriate lengths. Prior to reaching the plugmaker, the tow generally passes over and around the top delivery roll, through the nip between the delivery roll path and around the bottom delivery roll in an S-wrap configuration. The S-wrap is necessary to prevent slippage of the tow through the nip of the two metal rolls.

Several problems have developed with this configuration. Metal rolls were originally chosen for use in the delivery roll position because they would be unaffected by plasticizer. Because of the small gripping area in the nip between the two metal rolls, it was necessary to wrap the tow around the rolls in the S-wrap configuration. The S-wrap itself, however, causes several problems. As the tow passes around the rolls, it experiences a significant amount of centrifugal force. As a result, part of the plasticizer that has just been applied is thrown off the tow, not only creating a housekeeping problem but making it more difficult to control plasticizer level on the tow, especially as process speed is varied.

The centrifugal force also applies tension to the tow which can shorten the capability range of the tow being processed.

The straight-through feed rolls 32 disclosed herein prevent these problems by eliminating the application of centrifugal force to the tow. The potential slippage problem of the tow through the nip of the rolls is solved by rubber coating both rolls. A special plasticizer-resistant synthetic rubber must be used for this application.

One additional benefit that occurs with this system relates to plasticizer distribution. The squeezing force exerted by the two rubber rolls tends to spread and distribute the droplets of plasticizer inside the tow band. This type of improvement is difficult to obtain with metal delivery rolls since nonuniformities in the tow band such as thick streaks tend to separate the rolls and prevent uniform application of pressure across the band. The rubber rolls on the other hand conform to the thickness of the band and squeeze it in a much more uniform manner.

Figure 6:
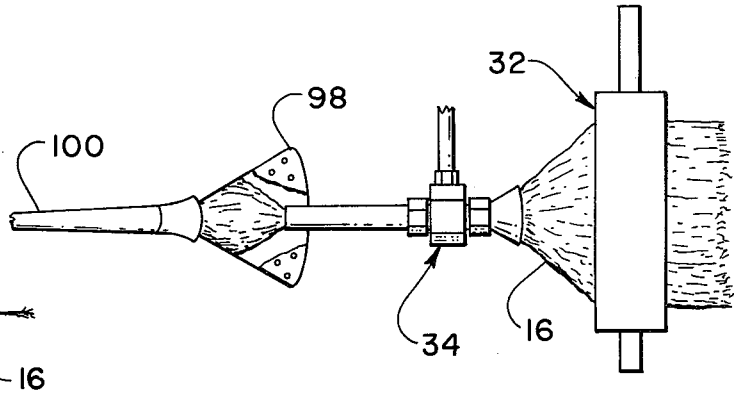
FIG. 6 is a plan view of one of the straight-through feed or delivery rolls and a tow transport jet and illustrating the appearance of the tow as it emerges from the transport jet for subsequent feed into the trumpet partly broken away and plugmaker tongue of a garniture (not shown).

The two band finally passes from the straight-through feed rolls 32 into the transport jet 34 (FIG. 6) for subsequent passage therefrom into the trumpet 98 and plugmaker tongue 100 of a garniture or filter rod-making apparatus (not shown). The transport jet serves as a pneumatic device for pulling upon the tow band and forwarding it into the garniture.

The transport jet maintains a small amount of tension sufficient to remove the tow band from the straight-through delivery rolls 32 and keeps the tow band from wrapping therearound.

It is theorized that since the two band is being moved at high speeds, from about 300 to about 600 meters per minute, the transport jet's action will tend to stretch the tow band and extend the crimp in the fiber in a nonpermanent manner. As the tow band is pulled through the jet and then exits, the crimp recovers as a consequence of the tow band's hitting a "wall" of relatively nonmoving air. The effect may be likened to that of yarn ricocheting off a hard surface, thus retarding the speed of the yarn and thereby forcing the crimp to recover. The observed effect is that the emerging tow blossoms or "balloons" to a greater mass per unit length upon exit from the transport jet. The overall consequence of this action is that the filter tow will have enhanced "capability".

The invention has been described in detail with particular reference to preferred embodiments thereof, but it will be understood that variations and modifications can be effected within the spirit and scope of the invention.

I claim:

1. A process for treatment of tow in preparation for forming tobacco smoke cigarette filter rods comprising the steps of withdrawing a continuous multifilament crimped tow from a supply source;

banding the crimped tow to a predetermined width wider than the tow at the supply source by removing false twist from the tow, spreading the tow and partially breaking up bundles of crimped filaments;

feeding said banded tow to a first zone and applying tension axially to the filaments across the width of said banded crimped tow to extend the crimp in and to partially deregister the crimped filaments within said tow and to partially bloom the tow;

feeding the partially bloomed banded crimped tow to an enclosed second zone and further spreading the width of the tow within said second zone into a wide flat bundle of filaments by impelling a flat gaseous compressed stream in impingement against opposite sides of and across the width of said bundle of filaments at an angle less than 90° to the longitudinal axis of said bundle sufficient to penetrate the bundle, to encompass the filaments with said gaseous compressed stream and to propel the bundle toward and through a tapering exit of said second zone;

feeding said bundle of filaments into a partially enclosed, wide rectangular third zone and therein momentarily confining and rapidly decelerating the linear speed of said bundle, applying compression against the mass of said bundle and allowing said bundle to be momentarily stored under conditions of low longitudinal tension, simultaneously allowing the compressed gaseous streams to expand and escape from said third zone at a location prior to the exit for said bundle from said wide rectangular third zone and thereby separate and bloom said filaments and cause said filaments to fill said wide rectangular third zone and to relax and recover a portion of their crimp, thereby forming a flat wide low density bloomed tow;

feeding the bloomed filaments of the wide flat low density tow to a fourth zone and uniformly applying plasticizer at a consistent rate to both sides of and through said tow across the width thereof;

feeding said tow to a fifth zone through and between two rolls to squeeze and to spread the plasticizer more uniformly on said filaments, and then feeding said tow onward for subsequent processing into filter rods.

2. A process as defined in claim 1 and further comprising the steps of feeding said bloomed filaments of the wide flat low density tow to a sixth zone and therein applying tension to the tow sufficient to remove the tow from the rolls in the fifth zone and to extend the crimp in the filaments in a nonpermanent manner, and to impel the tow from the sixth zone into a relatively quiescent area at a velocity sufficient to cause retarding of such velocity upon hitting such area to thereby enable recovery of the crimp in the filaments.

3. A process as defined in claim 1 wherein said banded tow is fed to said first zone and differential tension is applied axially to alternating segments of said tow across the width of said banded crimped tow.

4. A process as defined in claim 1 wherein said tow is fed to said fifth zone through and between two rubber rolls.

5. A process as defined in claim 1 wherein said plasticizer is applied in the form of an aerosol to said tow.

* * * * *